United States Patent [19]

Olson

[11] Patent Number: 4,856,982

[45] Date of Patent: Aug. 15, 1989

[54] APPARATUS FOR EXHAUSTING COMBUSTION GASES FROM A GAS WATER HEATER

[75] Inventor: Kenneth A. Olson, Minneapolis, Minn.

[73] Assignee: Tjernlund Products, Inc., White Bear Lake, Minn.

[21] Appl. No.: 166,758

[22] Filed: Mar. 3, 1988

Related U.S. Application Data

[63] Continuation of Ser. No. 72,420, Jul. 13, 1987, abandoned.

[51] Int. Cl.[4] ..... F23N 3/00

[52] U.S. Cl. ..... 431/20; 431/89; 126/361; 122/13 R

[58] Field of Search ..... 126/351, 361; 122/14, 122/17, 13 R; 431/20, 22, 31, 89, 90

[56] References Cited

U.S. PATENT DOCUMENTS

| | | | |
|---|---|---|---|
| 2,140,466 | 12/1938 | Betz et al. | 431/22 |
| 2,688,064 | 8/1954 | Traver | 337/321 |
| 2,714,644 | 8/1955 | Harrison | 337/348 |
| 2,801,315 | 7/1957 | Rosenberg et al. | 337/348 |
| 3,494,551 | 2/1970 | Snider | 337/321 |
| 3,801,258 | 4/1974 | Mutchler | 431/90 |
| 4,437,829 | 3/1984 | Baker | 431/22 |
| 4,468,192 | 8/1984 | Jaeger | 431/20 |
| 4,672,919 | 6/1987 | Staats | 122/13 R |

*Primary Examiner*—Margaret A. Focarino
*Attorney, Agent, or Firm*—Palmatier & Sjoquist

[57] ABSTRACT

The present invention includes an exhaust fan for exhausting combustion gases from a gas fired water heater, a gas pressure diaphragm switch for operating the exhaust fan in response to fuel flowing to the burner of the water heater, and a safety device for preventing fuel flow to the burner upon detecting undesirable changes in combustion gases. The apparatus further includes a time delay to continue operation of the exhaust fan and exhaust residual combustion gases for a short time after fuel flow to the burner has ceased. In one form the time delay is a time delay relay switch and in another form it is a flow restricting orifice that restricts the flow of fuel from the gas pressure diaphragm switch, thereby maintaining a closed circuit to the exhaust fan.

7 Claims, 4 Drawing Sheets

COMBUSTION GASES
17
64
17
59
54
TIME DELAY RELAY SWITCH
58
62
EXHAUST FAN
61
17
15
18
HOT WATER
16
14
83
19
70
COLD WATER
LINEAR LIMIT SAFETY DEVICE
74
71
86
SPACE BETWEEN WATER HEATER AND BONNET
GAS FUEL
10
76
51, 53
12
GAS FIRED HOT WATER HEATER
13
53
MICROSWITCH
51
79
78
50
52
GAS PRESSURE DIAPHRAGM SWITCH
12
47
SOLENOID VALVE
12
11
29
MAIN CONTROL VALVE

EXHAUST FAN
TIME DELAY RELAY TIMER
61
54
COMBUSTION GAS
FLUE
16
59
58
THERMAL SENSOR
14
70
71
83
COMBUSTION GASES
86
GAS FUEL
12
53
LINEAR LIMIT SAFETY SWITCH
BAFFLE
84
GAS PRESSURE DIAPHRAGM SWITCH
MICROSWITCH
49
47
10
DIAPHRAGM
13
29
33
41
34
MANUAL VALVE
28
76
31
32
30
PRESSURE TAP
GAS FUEL
25
11
27
85
21
25
20
20
24
24
22
20
12
26
GAS BURNER
79
SOLENOID VALVE
23
MAIN CONTROL VALVE
THERMAL SENSOR

APPARATUS FOR EXHAUSTING COMBUSTION GASES FROM A GAS WATER HEATER

This is a continuation of copending application Ser. No. 072,420 filed on Jul. 13, 1987 now abandoned.

BACKGROUND OF THE INVENTION

1. Field of the Invention

The present invention relates to an apparatus for ventilating gases and, more particularly, to an apparatus for actively ventilating combustion gases from a gas water heater.

2. Description of the Prior Art

Conventionally, the products of natural gas combustion have been passively ventilated from gas water heaters and the home environment. The combustion gases typically rise passively through a baffle in the heater to a bonnet attached to the top of the heater, through the bonnet to a vertical flue or chimney through the roof of a house to the outside environment. In certain areas where gas has only recently been available for gas fired water heaters, many existing homes lack chimneys.

SUMMARY OF THE INVENTION

The present invention is an apparatus for actively exhausting combustion gases from a gas water heater, especially where there is no chimney available for drawing away combustion gases. A feature of the invention is a sensing device having a diaphragm that senses the flow of fuel to a burner of the heater. The sensing device controls a switch which energizes an exhaust fan to draw and exhaust combustion gases to the exterior of a residence or building in which the heater is installed. The sensing device closes the switch when it senses a flow of fuel and re-opens the switch when it senses a lack of a flow of fuel.

The switch is typically a mechanical switch that operates a relay. The mechanical switch is connected to the diaphragm sensing device and the relay is connected to the exhaust fan. When the diaphragm sensing device operates the mechanical switch, the mechanical switch activates the relay, which in turn allows the operation of the exhaust fan.

The apparatus may include a time delay device to continue operation of the fan and exhaust residual gases for a short time after the flow of fuel is terminated. In one form, the time delay device is incorporated into the relay and, in another form, the time delay device is a flow-restricting orifice that is incorporated into the sensing device. The orifice restricts the release of gas from the diaphragm, thereby impeding return of the diaphragm and delaying the re-opening of the mechanical switch and the deenergization of the exhaust fan.

The apparatus may also include a safety device that senses spillage of combustion gases between the heater and the draft hood, which may occur when the flue is plugged. If spillage is sensed, the safety device closes a valve to prevent the flow of fuel to the heater. Since the safety device operates on a 24 volt circuit, it is less sensitive to outside influences than conventional devices which rely on millivolts produced by a thermal sensor to close a valve to prevent the flow of gas to the heater.

An advantage of the present invention is that it makes it practical to install a gas water heater in a home without a chimney because it allows horizontal, as well as vertical, orientations of the chimney to be contructed.

Whereas conventional passive ventilating systems mandate vertical flues, active ventilating systems may draw combustion gases horizontally as well as vertically.

A further advantage of the present invention is that the apparatus may be readily connected to conventional gas water heaters. The apparatus, namely the gas pressure diaphragm switch, is connected to a pressure tap conventionally formed in the control box housing of the gas water heater.

A still further advantage of the present invention is that, although it is intended for homes without existing flues, it may be attached to existing vertical, passive ventilating flues. By converting a passive ventilating flue to a mechanical ventilating flue, the chances of leakage are greatly reduced. Combustion gases rise from a passive ventilating flue without mechanical inducement. In contrast, the mechanical ventilating apparatus ventilates combustion gases by actively drawing the gases from the home environment. Since the mechanical ventilating apparatus continually draws gases to the outside environment, a negative pressure exists inside the flue in relation to the pressure of the home environment surrounding the flue. Therefore, if a perforation exists in the flue, the mechanical ventilating apparatus will draw air in through the perforation, instead of allowing combustion gases to leak out of the perforation to invade the home environment.

DETAILED DESCRIPTION OF THE PREFERRED EMBODIMENTS

Figure 1:
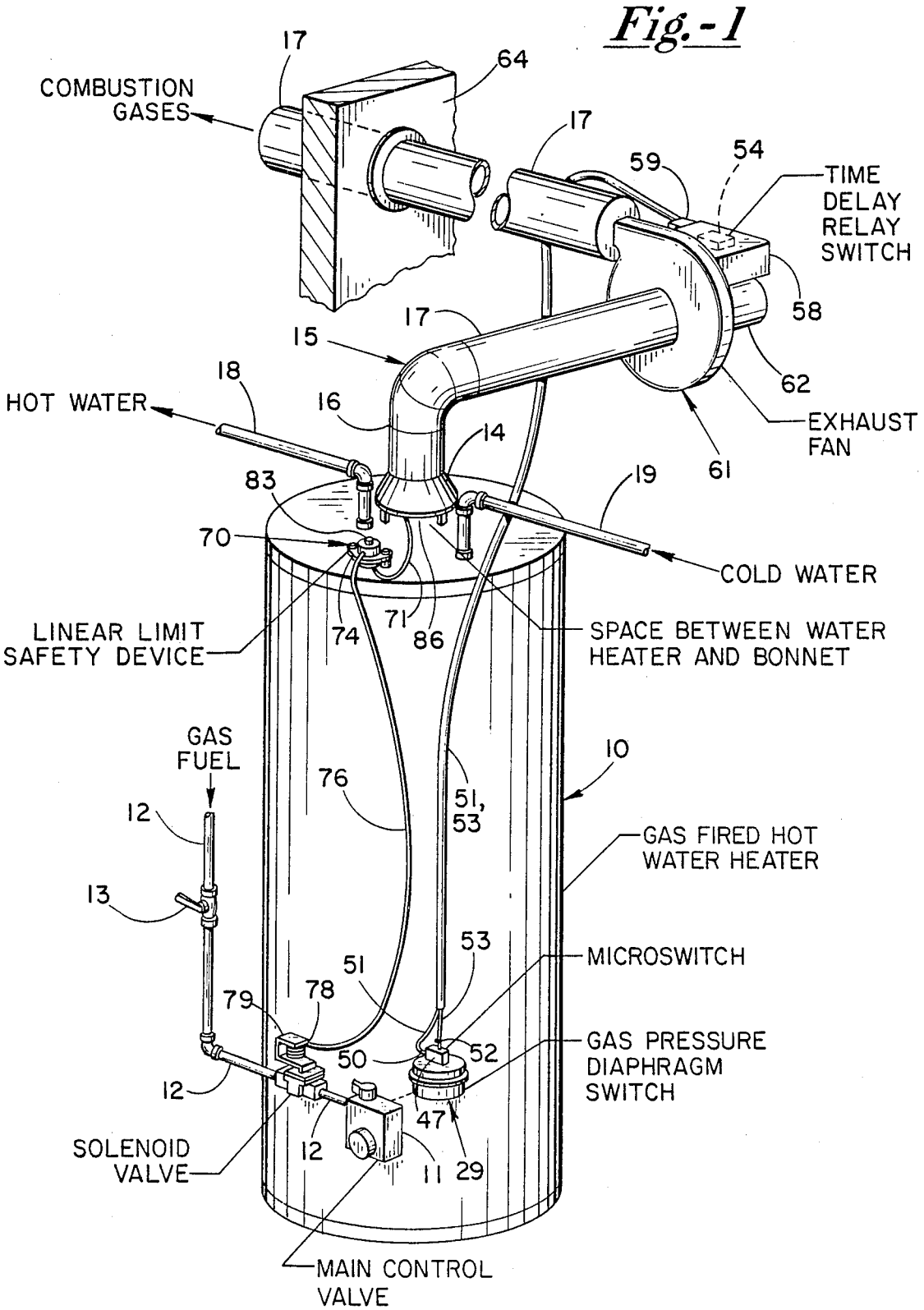
FIG. 1 is a perspective, partially diagrammatic, view of the apparatus connected to a gas fired water heater.

As shown in FIG. 1, a gas fuel water heater 10 having a control 11 is connected to a main gas fuel line 12 which provides the gas fuel from an outside source. A manual valve 13 is connected to the line 12 upstream from the control 11. The valve 13 is typically open, but may be manually closed to prevent the flow of fuel to the water heater 10. A bonnet 14 and a flue 15 having a vertical pipe 16 and a pair of horizontal pipes 17 are connected to and exhaust combustion gases from the water heater 10. A hot water outlet 18 and a cold water dip tube 19 is connected to and allows circulation of water through the water heater 10.

Figure 2:
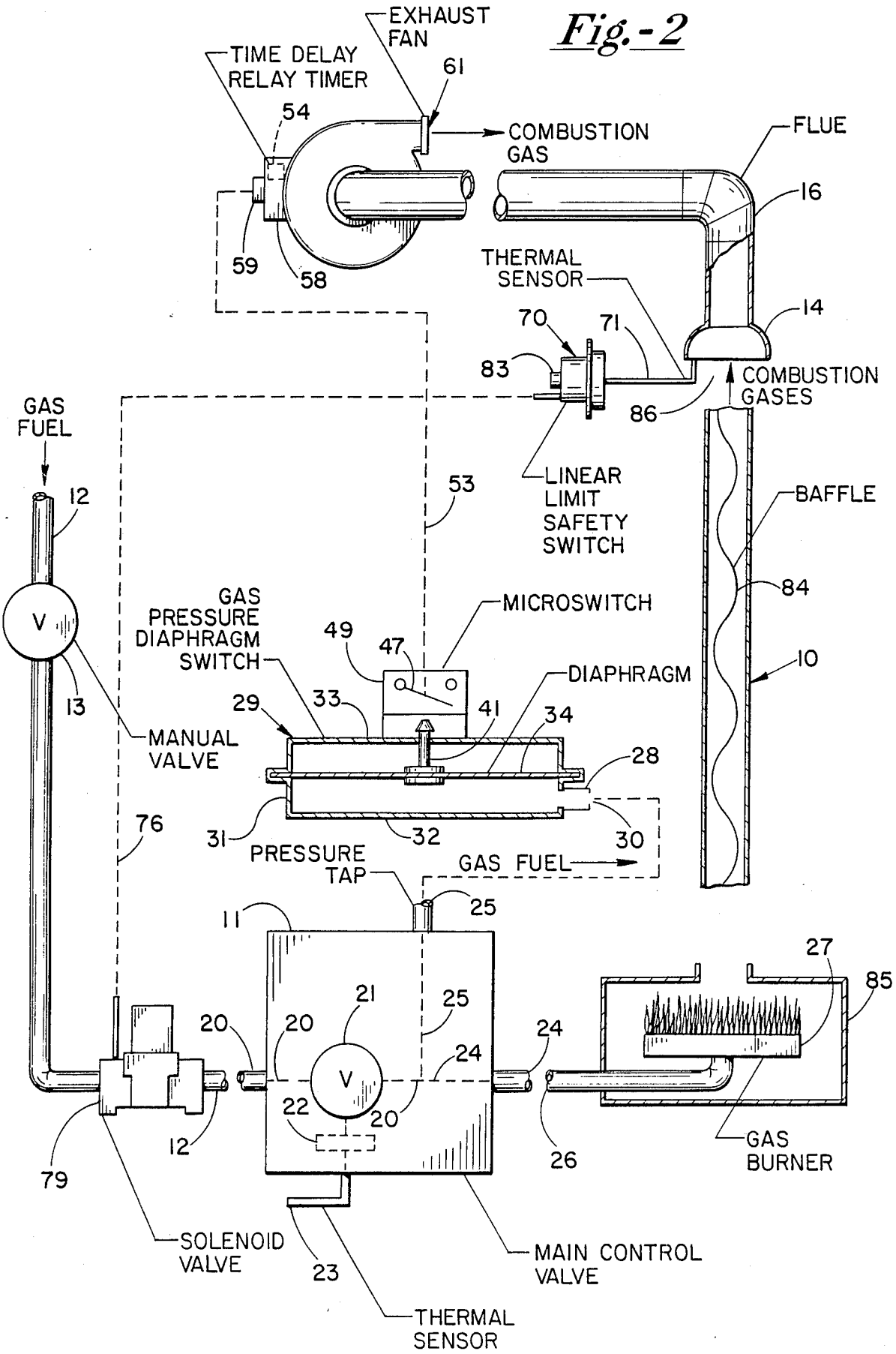
FIG. 2 is a diagrammatic sketch of the gas circuit of the apparatus.

As shown in FIG. 2, the main gas line 12 is connected to a passage 20 formed in the control 11. A main control valve 21 is connected to and controls gas flow through passage 20. A valve operator 22 is connected to the valve 21 and a thermal sensor 23. The thermal sensor 23 extends to the inside of the water heater 10 to sense the water temperature. The thermal sensor 23 operates the valve operator 22, which operates the main control valve 21.

The passage 20 diverges into a pair of passages 24 and 25 formed in the control 11 so that fuel flowing through passage 20 and valve 21 is diverted to flow through passages 24 and 25. Passage 24 is connected to a pipe 26, which is connected to a burner 27. Fuel flowing through passage 24 flows through pipe 26 and into burner 27 to be burned. Passage 25 is typically a pressure tap passage that allows the measurement of the fuel pressure in passage 24 leading to the burner 27. Except for the measurement of fuel pressure, passage 25 is typically plugged.

A port housing 28 of a gas pressure diaphragm switch 29, a feature of the present apparatus, is connected to the pressure tap passage 25 so that gas flowing through pressure tap passage 25 flows into the diaphragm switch 29 through a port 30 formed in the port housing 28. By utilizing passage 25 and port 30, fuel flowing through main gas valve 21 flows into the diaphragm switch 29 and the burner 27 substantially simultaneously.

Figure 5:
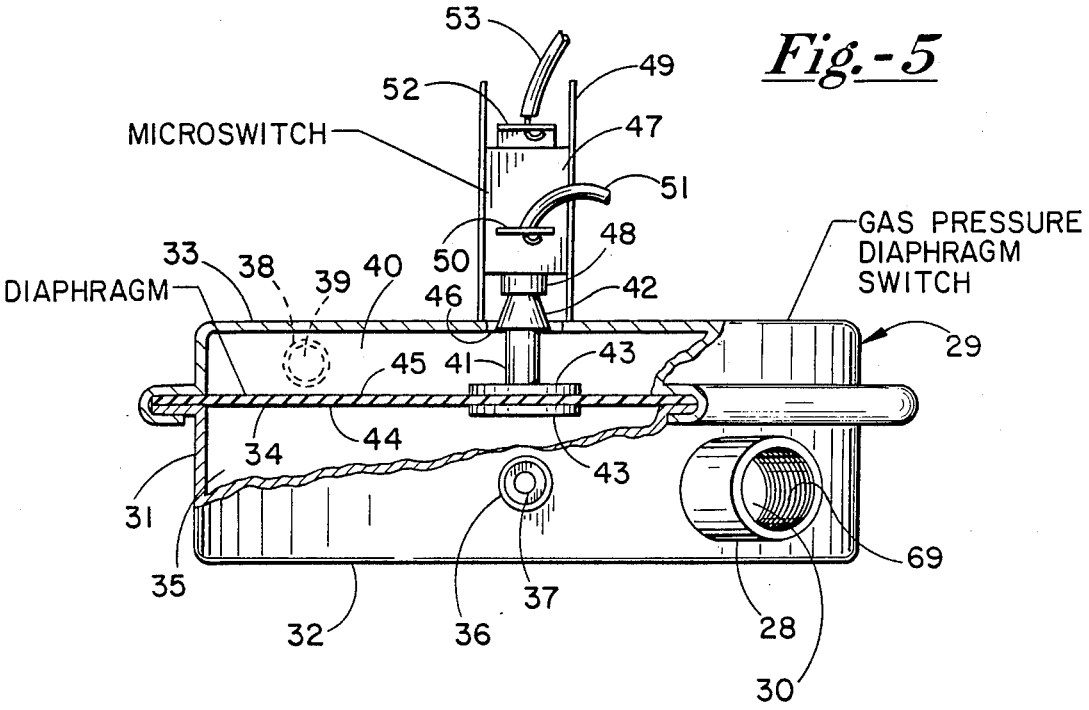
FIG. 5 is an elevational view of the gas diaphragm switch.
Figure 6:
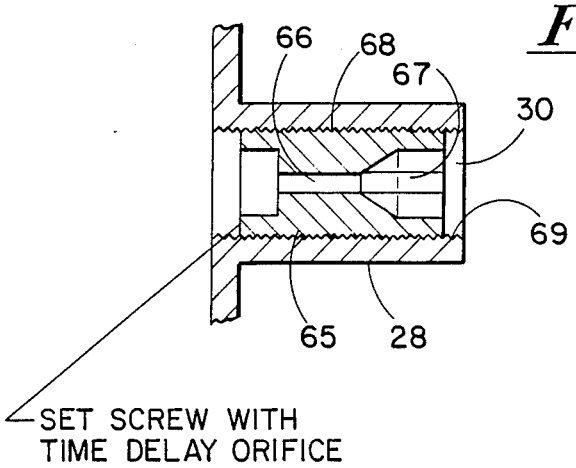
FIG. 6 is a sectional view of an alternate embodiment of the time delay device.

The gas pressure diaphragm switch 29 includes a housing 31 having a base 32 and a cover 33 as shown in FIG. 5. A flexible diaphragm 34 is circumferentially clamped between the top end of the base 32 and the bottom end of the cover 33. The moveable diaphragm 34 is moveable toward the top face of the cover 33 by fuel flowing through port 30 and into an enlargeable gas pressure receiving chamber 35 formed by the base 32 and the diaphragm 34.

A gauge port housing 36 having a gauge port 37 is formed in the base 32. The gauge port 37 allows the measurement of fuel pressure in chamber 35, passage 24, and passage 26 leading to the burner 27. The gauge port 37 thus takes over the conventional role of the typically plugged pressure tap passage 25 to measure fuel pressure in control 11. Port 37 is normally plugged, except when pressure measurements are being made.

A safety port housing 38 having a safety port 39 is formed in the cover 33. The safety port housing 38 may be connected to a pipe (not shown) leading to the burner 27. If fuel leaks from enlargeable chamber 35, through diaphragm 34, and into a compressible chamber 40 formed by cover portion 33 and diaphragm 34, the safety port allows the leaking fuel to flow to and be safely burned by the burner 27.

A stem 41 having a tapered head 42 at one end and a clamp 43 at its opposite end is clamped by clamp end 43 to a central portion of faces 44 and 45 of the diaphragm 34. The stem 41 protrudes from face 45 of the diaphragm 34 and through an aperture 46 formed centrally in the cover 33 so that the tapered head 42 may extend outside the housing 31.

A switch 47 having a mechanical operating button 48 and a pair of mounting brackets 49 is connected to the cover 33 of the diaphragm switch 11. The mounting brackets 49 mount the switch 47 about the aperture 46 so that the tapered head 42 of the stem 41 depresses the operating button 48 into the switch 47. When the operating button 48 is not depressed into the housing of the switch 47, the switch 47 is open. When the operating button 48 is depressed into the housing of the switch 47, the switch 47 is closed. The switch 47 includes a contact 50 having a lead 51 and a contact 52 having a lead 53.

The diaphragm switch 29 is operated by fuel flow into chamber 35. Fuel flows from passage 25 of the control 11, through port 30 and into chamber 35. As fuel pressure is created in chamber 35, the diaphragm 34 and stem 41 begin to move. The stem 41 begins to depress the control button 48 of the switch 47. Once the fuel pressure in chamber 35 reaches a prescribed pressure, the switch 47 is closed by the stem 41. Consequently, the gas pressure diaphragm switch 29 is a sensing means for sensing fuel flow to the burner 27. By sensing gas pressure produced in chamber 35, the gas pressure diaphragm switch 29 therefore senses fuel flow to burner 27.

A time delay relay switch 54 having a relay 55, a relay switch or switch means 56 and a time delay means 57 may be connected to the switch 47. The lead 53 of the switch 47 is connected to a contact 58 of the time delay relay switch 54. As shown in FIG. 1, the time delay relay switch 54 is attached in a housing 58 connected to an inlet 59 in which contact 58 may be formed.

The relay 55 is operated by the switch 47 and operates the relay switch 56. When the switch 47 closes, the relay 55 closes the relay switch 56 so that the relay switch 56 is connected to a contact 59. When the switch 47 is re-opened, the relay 55 may re-open relay switch 56 so that the relay switch 56 is connected to contact 60.

Figure 3:
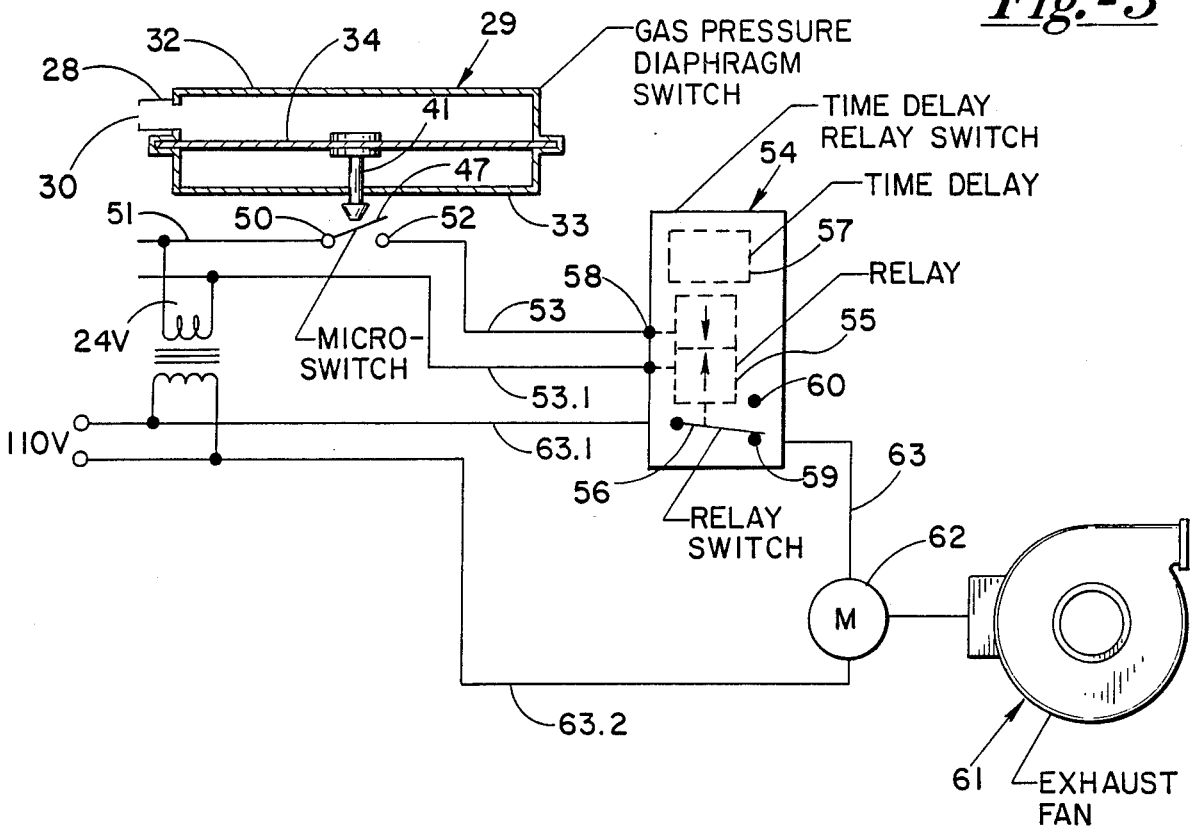
FIG. 3 is a diagrammatic sketch of the electrical circuit of the apparatus.

The time delay 57 may be connected to the relay 55 to delay for a prescribed period of time the operation of the relay 55 and the re-opening of the relay switch 56, as shown in FIG. 3. When the switch 47 is re-opened, the time delay 57 is activated. When the time delay 57 is activated, it prevents the relay 55 from re-opening the relay switch 56 for the prescribed period of time. The time delay 57 is deactivated after the prescribed period of time. Once the time delay 57 is deactivated, the relay 55 re-opens the relay switch 56.

An exhaust fan 61 having a motor 62 is connected to the relay switch 56 by a lead 63 as shown in FIG. 3. The relay switch device 54 having the switch 56 is connected to a housing 58, which is connected to the exhaust fan 61, as shown in FIG. 1. When the relay switch 56 is closed, the exhaust fan 61 is energized. When the relay switch 57 is opened, the exhaust fan 61 is deenergized. Consequently, the time delay 54, the relay 55, the gas pressure diaphragm switch 29, and the pressure tap passage 25 are a control means controlling the operation of the relay switch 56 and the exhaust fan 61.

The exhaust fan 61 is connected to a flue 15 as shown in FIG. 1. The exhaust fan 61 may be connected to either horizontal sections 17 or vertical section 16 of the flue 15 or a combination thereof. The exhaust fan 61 is typically installed near an exterior wall 64 of a building to draw, rather than push, combustion gases from the water heater 10. Depending of the type of flue, a vent hood or cap may be connected to the flue outside of the building.

Figure 4:
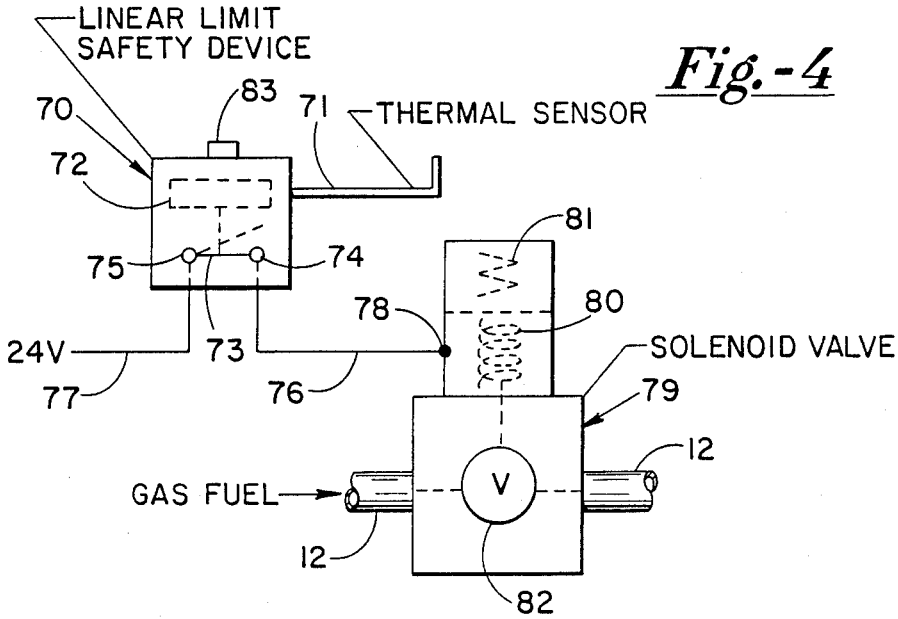
FIG. 4 is a diagrammatic sketch of the electrical circuit of the safety device.

As shown in FIG. 4, the present apparatus includes a safety device or linear limit switch 70 having a thermal sensor 71, a switch operator 72, and a limit switch 73. An end of the heat sensing means or heat sensing capillary or thermal sensor 71 is connected near the bonnet 14 of the water heater 10 to sense spillage between the bonnet 14 and the water heater 10. A second end of the thermal sensor 71 is connected to the switch operator 72. It should be noted that a bimetallic disc thermostat (not shown) may be used instead of linear limit switch 70. Whereas the heat sensing capillary is placed circumferentially about the perimeter of the bonnet 14, a pair of bimetallic disc thermostats may be used by placing them opposite one another about the bonnet 14 and connecting them in series.

The switch operator 72 is connected to the normally closed switch 73 having a pair of contacts 74 and 75. An end of a lead 76 is connected to contact 74 and an end of a lead 77 is connected to contact 75. A second end of the lead 76 is connected to a contact 78 of a gas solenoid valve 79.

The gas solenoid valve 79 has a solenoid 80, a spring 81, and a valve 82. The solenoid 80 is connected to the contact 78 and operates the spring 81. The spring 81 operates the valve 82. The valve 82 is connected to the main gas line 12 downstream from the manual valve 13 and upstream from the control 11.

A manual reset button 83 is connected to the linear limit safety device 70 and is operated to reset or close switch 73 after the switch 73 has been opened by the switch operator 72. The switch 73 is reset by manually depressing the button 83 into the housing of the device 70. The closing of the switch 73 allows the energization of the solenoid 80 and the opening of the valve 82 for the flow of fuel. Although a linear limit switch having an automatic reset may be used, it may be desirable to use the linear limit switch 70 having the manual reset button 83.

As shown in FIGS. 3 and 4, the electrical circuits of the apparatus operate on 24 and 110 volts. A 24 volt circuit having conductors 51, 53, and 53.1 connects the gas pressure diaphragm switch 29 to the time delay relay switch 54. A 110 volt circuit having conductors 63, 63.1, and 63.2 connects the time delay relay switch 54 to the motor 62 of the exhaust fan 61. A 24 volt circuit having conductors 76 and 77 connects the linear limit safety device 70 to the gas solenoid valve 79.

In operation, when hot water is used in a building, such as when a hot water faucet is turned on, hot water is drawn into the hot water outlet 18 from the water heater 10. Simultaneously, cold water flows into the heater 10 through the dip tube 19. If the influx of cold water lowers the temperature of the water in the heater 10 to a predetermined level, the thermal sensor 23 operates the valve operator 22, which in turn opens the main gas valve 21 in control 11.

When the main gas valve 21 is opened, fuel flows from the main gas line 12 and through valve 21 if the gas solenoid shut-off valve 79 is energized and open, and the manual valve 13 is open. After fuel flows through valve 21, it is diverted from passage 20 into passages 24 and 25. Fuel flowing through passage 24 flows into burner passage 26 and into burner 27 to be burned where it is ignited by a pilot light (not shown). At the same time that fuel flows to the burner 27, fuel flows through passage 25 to the diaphragm switch 29.

As fuel flows into diaphragm switch 29 through port 30, gas pressure is created in chamber 35. The diaphragm 43 then begins to flex toward the top face of the cover 33 and stem 41 begins to depress the operating button 48. Once the fuel pressure in chamber 35 reaches a prescribed level and the diaphragm 34 and stem 41 move a prescribed distance, the switch 47 closes.

As the switch 47 closes, it operates the relay 55. The relay 55 in turn closes the relay contacts 56, which energizes the exhaust fan 61. The time for the exhaust fan 61 to be energized after the valve 21 has been opened is typically less than a second when the time delay relay switch 54 is being utilized.

Once the exhaust fan 61 is energized, it begins to draw combustion gases from flue 15, the bonnet 14, a baffle 84 formed in the water heater 10 and a combustion chamber 85 housing the burner 27, and the combustion gases are drawn to the exterior of the building. The exhaust fan 61 may also draw dilution air from the inside environment through a space 86 formed between the lower end of the bonnet 14 and the upper end of the water heater 10.

Operation of the exhaust fan 61 and burner 27 continues as valve 21 remains open. As fuel flow is maintained through valve 21, fuel pressure is maintained in chamber 35, which maintains the stem 41 against operating button 48, which in turn maintains a closed switch 47 and switch 56 to allow the exhaust fan 61 to maintain operation.

Once the water in the water heater 10 reaches a prescribed temperature, the thermal sensor 23 operates the valve operator 22, which closes the valve 21. Closing of valve 21 terminates fuel flow to the burner 27 and the diaphragm 29. Consequently, gas bleeds backwardly from diaphragm 29, through passages 24, 25, and 26 to be burned in the burner 27, or otherwise drawn up the flue. When the fuel pressure in chamber 35 of the diaphragm switch 29 decreases to a prescribed level, the stem 41 allows the switch 47 to re-open, which in turn activates the time delay of switch 54. After the time delay 57 is deactivated, the relay 55 re-opens the contacts 56 to deenergize the exhaust fan 61. Typically, the time delay 57 is activated for 45 seconds to four minutes to allow the exhaust fan 61 to draw residual combustion gases from the water heater 10.

If the thermal sensor 71 senses spillage, the switch operator 72 opens the switch 73. As the switch 73 is opened, the solenoid 80 is deenergized and allows the spring 81 to close the valve 82, preventing the flow of fuel to control 11 and the burner 29. As valve 82 is closed, the diaphragm switch 29 senses the lack of fuel flow to the burner 27 and deenergizes the exhaust fan 61. It should also be noted that a failure in the building's electrical system may deenergize the solenoid 80, thereby closing valve 82 and preventing fuel flow to the burner 27.

In an alternate form of time delay, a flow restricting set screw 65 having a flow-restricting orifice 66 is utilized. The orifice 66 is formed axially in set screw 65 and allows fluid flow in either direction. A hexagonal recess 67 is formed axially in the set screw 65 for an Allen wrench. The set screw 65 has threads 68 and port housing 28 has threads 69 so that set screw 65 may be threaded into the fitting 28 on the diaphragm housing 31.

Once the set screw 65 is threaded into the port housing 28 of the diaphragm switch 28, the effective diameter of the port 30 is reduced to the diameter of the orifice 66. Consequently, fuel flow to and from diaphragm switch 29 is restricted.

Fuel flow from chamber 35 is restricted by orifice 66 connected to port housing 28 when valve 21 is closed. Immediately after valve 21 is closed, the fuel pressure in chamber 35 may be about the same as the fuel pressure in the main gas line 12. Subsequently, as fuel bleeds from chamber 35, through port 30 and passages 24, 25, and 26 and into burner 27 to be burned, the fuel pressure in chamber 35 decreases at an ever slower rate. Accordingly, the switch 47 and the relay switch 56 remain closed while fuel bleeds from chamber 35. Once the fuel pressure in chamber 35 decreases to a prescribed level, the stem 41 allows the switch 47 to re-open. The switch 47 then operates the relay 55, which re-opens the relay switch 56, which in turn deenergizes the exhaust fan 61. When the time delay orifice 66 is used, the time delay 57 of the relay may be eliminated. Typically, depending on the size of the orifice, the time delay orifice 66 delays the deenergization of the exhaust fan 61 for ten seconds to one to two minutes when the valve 21 is closed.

With orifice 66 connected to port housing 28, fuel flow to chamber 35 is also restricted and the creation of fuel pressure in and enlargement of chamber 35 is delayed when valve 21 is opened. Accordingly, the closing of the switch 47 and the relay switch 56 and the energization of the exhaust fan 61 are delayed. Typically, the delay is one to three seconds from when the valve 20 is opened to when the exhaust fan 61 is energized.

We claim:

1. An apparatus for exhausting combustion gases from a gas fuel water heater having a gas burner to which fuel is supplied by a fuel line and a flue which allows ventilation of the combustion bases from the interior of a building in which the heater is installed to the exterior, comprising an exhaust fan adapted for connection to the gas water heater for drawing and exhausting combustion gases to the exterior of the building, switch means connected with said exhaust fan for operating said exhaust fan, and control means connected with said switch means for operating said switch means, said control means including sensing means for sensing fuel flow to the burner of the water heater, said control means causing closing of said switch means in response to sensed fuel flow to the burner of the water heater, said sensing means also sensing the lack of fuel flow to the burner of the water heater, said control means causing reopening of said switch means in response to sensed lack of fuel flow to the burner of the water heater, said control means including time delay means for producing a time delay between said sensing of the lack of fuel flow by said sensing means and said reopening of said switch means so that said exhaust fan remains energized during said time delay to allow residual combustion gases to be exhausted after fuel flow to and operation of the burner have ceased, said time delay means including a time delay relay switch.

2. An apparatus according to claim 1 wherein said sensing means includes a housing, a diaphragm confined in said housing, a gas pressure receiving chamber defined by said diaphragm and housing, and a port formed in said housing for connection to the burner gas supply to permit gas flow to said chamber, said diaphragm connected to and operating said switch means, said diaphragm being operated by gas pressure in said chamber.

3. An apparatus according to claim 1 wherein the burner is supplied with gas fuel by a gas line upstream from the burner, said apparatus further including a safety device comprising a heat sensing means connected to the gas water heater and sensing spillage of combustion gases from the gas water heater, a switch connected to said heater sensing means, said switch being normally closed and being operable by said heater sensing means when said heater sensing means senses spillage of combustion gases for the gas water heater, and a valve adapted for connection with the gas line upstream from the burner of the gas water heater, said valve being deenergized and closed when said switch is opened to prevent the flow of gas to the burner of the gas water heater.

4. An apparatus according to claim 3 wherein said heat sensing means comprises a heat sensing capillary.

5. An apparatus according to claim 3 wherein said switch comprises a linear limit switch.

6. An apparatus according to claim 3 wherein said switch includes a reset switch.

7. An apparatus according to claim 6 wherein said rest switch comprises a manual reset switch.

* * * * *